US007624777B2

(12) United States Patent
Paller

(10) Patent No.: US 7,624,777 B2
(45) Date of Patent: Dec. 1, 2009

(54) SORTER HANDBAG

(76) Inventor: JoAnne Paller, 35 Bungalow Ct., Aiken, SC (US) 29803

( * ) Notice: Subject to any disclaimer, the term of this patent is extended or adjusted under 35 U.S.C. 154(b) by 310 days.

(21) Appl. No.: 11/235,476

(22) Filed: Sep. 26, 2005

(65) Prior Publication Data

US 2006/0126969 A1 Jun. 15, 2006

Related U.S. Application Data

(60) Provisional application No. 60/635,601, filed on Dec. 13, 2004.

(51) Int. Cl.
*A45C 1/02* (2006.01)
*A45C 3/00* (2006.01)
*A45C 11/32* (2006.01)
*A45C 13/02* (2006.01)

(52) U.S. Cl. ..... 150/112; 150/117; 150/151; 383/38; 383/117; 190/109; 190/112

(58) Field of Classification Search ..... 150/113, 150/150, 151, 100, 112, 117; 383/44, 36, 383/38, 43, 6, 67, 105, 117; 190/109, 112
See application file for complete search history.

(56) References Cited

U.S. PATENT DOCUMENTS

| | | | | | |
|---|---|---|---|---|---|
| 925,454 | A | * | 6/1909 | Burrows | 232/4 R |
| 1,658,294 | A | * | 2/1928 | Lewis | 150/150 |
| 1,936,358 | A | * | 11/1933 | Edmund | 150/117 |
| 1,965,040 | A | * | 7/1934 | Kelly | 209/370 |
| 2,210,875 | A | * | 8/1940 | Bauer et. al. | 453/49 |
| 2,467,662 | A | * | 4/1949 | Freiberg | 150/117 |
| 2,477,388 | A | * | 7/1949 | Moore | 150/112 |
| 2,608,228 | A | * | 8/1952 | Rose | 150/112 |
| 2,828,858 | A | * | 4/1958 | Tooke | 206/221 |
| 2,855,969 | A | * | 10/1958 | Shields | 150/101 |
| 2,904,091 | A | * | 9/1959 | Reed | 150/117 |
| 3,186,463 | A | * | 6/1965 | Yerg | 150/116 |
| 3,614,875 | A | * | 10/1971 | McCallun | 383/38 |
| 3,963,102 | A | * | 6/1976 | Carp | 190/108 |
| 4,022,261 | A | | 5/1977 | Russell | |
| 4,192,365 | A | | 3/1980 | Siegel | |
| 4,907,694 | A | | 3/1990 | Miller et al. | |
| 4,963,374 | A | * | 10/1990 | Brandel et al. | 426/107 |
| 5,048,582 | A | * | 9/1991 | Whitfield | 150/112 |

(Continued)

FOREIGN PATENT DOCUMENTS

| | | | |
|---|---|---|---|
| JP | 8103317 | * | 4/1996 |

(Continued)

*Primary Examiner*—Sue A Weaver
(74) *Attorney, Agent, or Firm*—J. Bennett Mullinax, LLC

(57) ABSTRACT

A bag for use in sorting items is provided. The bag includes a body that at least partially defines an upper compartment and a top opening to allow access to the upper compartment. A lower compartment is at least partially defined by the body. Both the upper and lower compartments are configured for holding items therein. The body defines a selectively closable lower compartment opening to allow access to the lower compartment. A partition is disposed between the upper and lower compartments. The partition defines a partition aperture to allow the transfer of items from the upper compartment to the lower compartment based on the size and shape of the items to sort the items between the upper and lower compartments.

18 Claims, 6 Drawing Sheets

U.S. PATENT DOCUMENTS

| | | | | | |
|---|---|---|---|---|---|
| 5,083,349 | A | * | 1/1992 | Axtell | 24/429 |
| 5,100,191 | A | * | 3/1992 | Detrick et al. | 294/3.6 |
| 5,184,724 | A | * | 2/1993 | Mayled | 206/466 |
| 5,288,150 | A | * | 2/1994 | Bearman | 383/38 |
| 5,681,113 | A | * | 10/1997 | Rifkin et al. | 383/5 |
| 5,749,447 | A | | 5/1998 | Hersh et al. | |
| 5,782,280 | A | | 7/1998 | Berry | |
| 5,829,502 | A | | 11/1998 | Distefano et al. | |
| 5,853,388 | A | * | 12/1998 | Semel | 604/82 |
| 6,152,572 | A | | 11/2000 | Cutler | |
| 6,283,183 | B1 | | 9/2001 | Cooper | |
| 6,394,157 | B2 | | 5/2002 | Luna | |
| 6,491,074 | B1 | | 12/2002 | Roegner | |
| 6,561,240 | B2 | | 5/2003 | Ma | |
| 6,637,485 | B1 | | 10/2003 | Sartena | |
| 6,945,293 | B1 | * | 9/2005 | Newton | 150/113 |
| 2003/0027671 | A1 | * | 2/2003 | Kuhn et al. | 473/597 |
| 2006/0236591 | A1 | * | 10/2006 | Cwiklinski et al. | 43/107 |

FOREIGN PATENT DOCUMENTS

| | | | | |
|---|---|---|---|---|
| JP | 200265332 | A | * | 3/2002 |

* cited by examiner

SORTER HANDBAG

RELATED APPLICATIONS

This application claims the benefit of U.S. Provisional Application Ser. No. 60/635,601, the entire contents of which are incorporated by reference herein in their entirety for all purposes.

FIELD OF THE INVENTION

The present invention relates to a bag such as a handbag or purse for carrying personal items and pertains more particularly to an improved design that automatically sorts out small items and makes them readily available in a separate compartment for easy access while containing larger items in readily identifiable pockets.

BACKGROUND

Bags such as handbags are commonly carried by women and sometimes by men. A large number and variety of items are commonly stored in handbags including brushes, combs, address books, cosmetics, keys, pagers, safety devices (e.g., whistles, antipersonnel spray) cellular phones, notes, wallets, checkbooks, small pieces of paper, coinage, etc. Other items, while not commonly stored in handbags, may be put there temporarily for safe keeping, such as jewelry, watches, cosmetics, etc. Sorting through these things to find a particular item can be time consuming, and cumbersome, especially if the item is small like a coin or coins, a finger ring, a key or small set of keys, earrings, a lipstick dispenser, etc. Failure to efficiently locate the required item causes frustration, inconvenience, loss of time and may even be dangerous in some situations (for example, if the missing item is a house or car key).

The large number of existing utility patents for systems that organize personal items and accessories in handbags, improve accessibility to such items, facilitate sorting among items within handbags, and make it easier to find these items suggests that many inventors have perceived a need for improvements in this area and that a substantial market may exist for new and better ideas. U.S. Pat. Nos. 4,192,365, 5,749,447, 5,829,502, and 6,283,183 are but a few examples of handbag designs that provide multiple internal storage compartments, containers, and retainers for particular items. U.S. Pat. Nos. 6,491,074, 6,561,240, and 6,394,157 are examples of organizing inserts with multiple compartments, segregated storage spaces, and various retaining devices that can be removed from a handbag if desired. U.S. Pat. Nos. 6,637,485 and 4,022,261 are examples of handbags with transparent walls or compartments that facilitate identifying and locating handbag items. U.S. Pat. No. 6,152,572 is an example of a device that illuminates the interior of a handbag to help find items in the handbag. Also, there are many examples of coin purses and pouches (e.g., U.S. Pat. Nos. 5,782,280 and 4,907,694) that facilitate locating and sorting coinage.

Although many existing handbag patents have merit and some have enjoyed commercial success, they have certain disadvantages that the proposed invention seeks to overcome. Designs that organize handbag contents by providing numerous individual storage compartments require that the handbag user know which item is in which compartment and that items are returned to their proper compartment after use. This type of knowledge and careful behavior must be exhibited even under stressful conditions, such as when the user is rushed or trying to accomplish multiple tasks simultaneously (e.g., tending to a crying infant while removing or inserting items in a handbag). It may also be necessary to locate the proper compartment for an item under low light conditions (e.g., in a theater) when only the sense of feel can be used. Another disadvantage of most existing designs is that they constrain the appearance of the handbag or purse because certain conformations are needed to make the organizer features of the handbag workable. These constraints may be in conflict with the desire of the handbag user to appear fashionable or to carry a handbag that matches a particular outfit or article of clothing.

A remaining disadvantage of most existing designs for organizer handbags is that efficient use of these designs requires or is at least facilitated by the sense of vision. Therefore, individuals with impaired vision may not find these designs useful.

The invention proposed in this patent application seeks to address the problem of organizing and sorting the items in a handbag, purse, or any other type of bag for carrying personal items and accessories by providing a design that automatically sorts smaller items from larger items, provides readily identifiable compartments that can be quickly located by touch, and is adaptable to a wide variety of shapes, styles, and designs.

SUMMARY

Various features and advantages of the invention will be set forth in part in the following description, or may be obvious from the description, or may be learned from practice of the invention.

This invention consists of a handbag for conveniently carrying, locating, and providing access to a variety of personal items and accessories. This handbag automatically sorts small items such as coinage, keys, small items of jewelry, small cosmetic items (e.g. a lipstick dispenser), etc. from larger items and makes them readily available in a separate compartment that can be easily accessed. It maintains larger items in easily accessed pockets that can be identified by touch.

The preferred embodiment consists of a handbag that can assume various shapes and sizes and can be composed of a variety of materials but is divided vertically by a horizontal partition into an upper and lower compartment. The two compartments are of approximately the same width (x axis) and depth (z axis) but differ in height (y axis), with the upper compartment usually being of greater height than the lower compartment. The partition that separates the two compartments is funnel shaped in that the edges of the partition, which are attached to the outer walls of the purse, are higher than the center of the partition. At the center of the partition is a slot or hole of appropriate size to permit small items such as coins, a key, a finger ring, an earring, etc. to pass from the upper compartment to the lower compartment. Such passage is "automatic" in the sense that jostling and movement of the handbag that result from the normal activities of the user will facilitate the passage of small items from the upper compartment into the lower compartment. The lower compartment has one or more openings that can be opened and closed by a convenient and secure means such as a zipper. By opening the lower compartment, the user has easy access to coinage and other small items and does not need to dig to the bottom of the handbag to find them as with other handbag designs. This method of accessing small items does not require vision, hence is particularly useful for the visually impaired.

The upper compartment of the handbag is primarily designed to carry larger items and make them easily accessible. To this end, the upper compartment, which has a closable opening at the top, is provided with a variable number of pockets, pouches, or enclosures that can be constructed in a variety of ways. Usually, these pockets will be attached to the interior of the upper compartment. Each pocket will have an opening near the top of the pocket, and this opening will be near but below the opening of the upper compartment. Also, each pocket will be of a size and shape to retain an item such as a cell phone, a wallet, a hair brush, a notepad, folded papers, checkbook, a key-ring, a personal safety device, etc. Thus, these larger items can be easily accessed by opening the upper compartment and reaching into the appropriate pocket. To facilitate identification of the particular pocket that contains a particular item, the upper portion of each pocket will be provided with a small charm or icon, composed of plastic, metal or some other appropriate material that identifies the item within the pocket. For example, the icon for the pocket containing a cell phone could be a small replica of a phone receiver, and the icon for the pocket containing a checkbook could be a small dollar sign, etc. Alternatively, the icon may take the form of alphabetical characters or Braille codes. In this manner, the user can readily identify the pocket containing the required item by opening the upper compartment of the handbag and feeling along the upper edges of the pockets to locate the appropriate icon. While this feature will be useful to all users (especially in low light situations) it will be particularly useful to the vision impaired since it eliminates the need to look into the purse. The icons need not be permanently affixed to the pockets but may be removable (such as with a pin or clasp) so that they can be moved among pockets and changed in orientation until the user attains the configuration that is most useful and agreeable.

The sorting and organizing features described above constitute a novel design that will minimize time spent searching for small items at the bottom of a handbag and provide easy, fast access to larger items. These features offer advantages to all users of handbags but particularly to vision impaired users since they obviate the need to look into a handbag to find things. The features of the sorter handbag described above have the advantage of being versatile and amenable to construction with a wide variety of materials and incorporation into many styles. Furthermore, the usefulness of these features is not restricted to handbags. They can also be incorporated into other types of bags or backpacks for carrying personal items and accessories. For example, the backpacks commonly used by children to carry books to school could be equipped with the previously described sorter feature to facilitate the recovery of small items placed into a opening located near the top of the backpack.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1A:
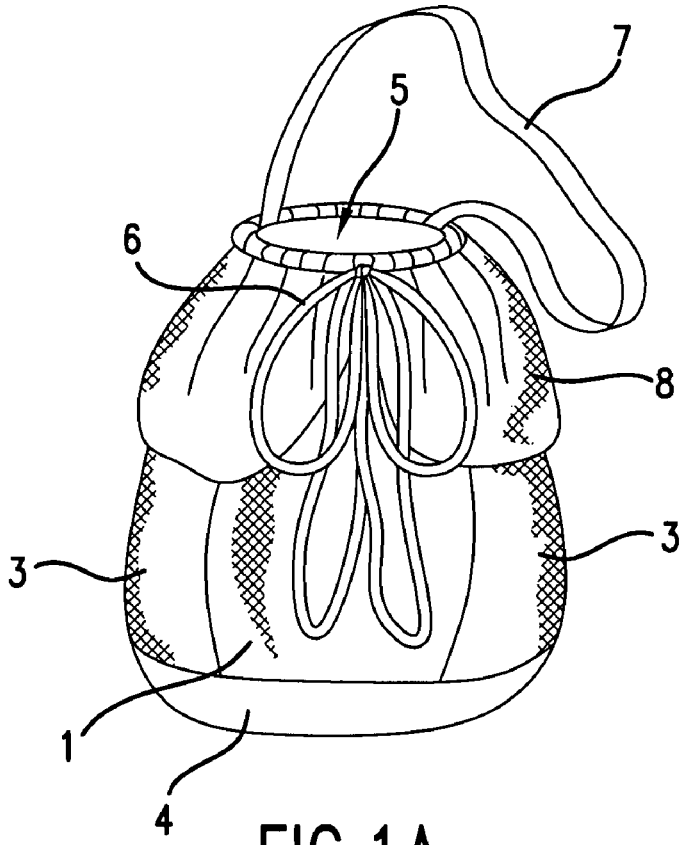
FIGS. 1A and 1B show front exterior and back exterior views of the first embodiment of the sorter handbag.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

Figure 1B:
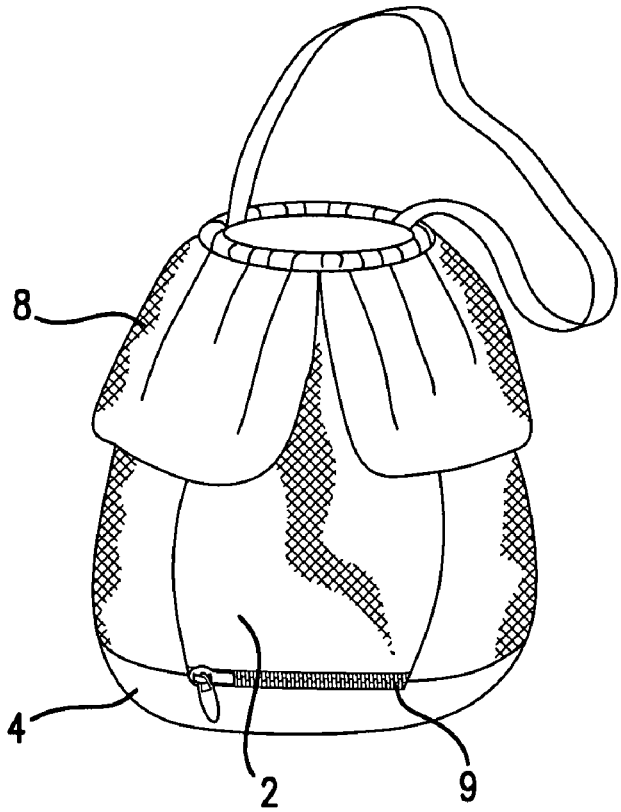

The sorter handbag provides new solutions to the persistent problem of locating and organizing items within a handbag or similar device for carrying personal items and accessories. FIGS. 1A and 1B provide details of a handbag that exemplifies the features offered by the sorter handbag. Although this handbag constitutes a simple and illustrative example of the features of the sorter handbag, it is not the only embodiment that can utilize these features. Various alternative embodiments will also be described in the following narrative.

The sorter handbag depicted in FIGS. 1A and 1B is a handbag or purse of the type that would normally be carried by a women or man during daily activities as a convenient means of transporting and maintaining access to personal items and accessories. Although other numbers of panels are possible, this particular example consists of four panels (front 1, back 2, and two sides 3) composed of a durable fabric or similar material. These panels (1-3) are joined vertically at their edges by stitching, sewing, or other appropriate means of attachment. A bottom panel (4) composed of the same or a different material is attached to and extends between the lower edges of the front (1) and side panels (3). The four side panels (3) and bottom panel (2) together constitute a simple bag that is enclosed on the sides and bottom but open at the top (5). The bag in FIGS. 1A and 1B is round to oval in cross section but other shapes are possible as well. The opening at the top (5) can be closed by means of a drawstring (6) that goes through a seam around the opening of the bag near the top (5), although many other means of closing and securing the opening at the top (5) are also acceptable (e.g, zipper, VELCRO®, or a flap with a button). The two ends of a carrying strap or handle (7) are attached near the top and middle of each of the side panels (3), although these could be attached to the front (1) and back panels (2) instead. Various types of ornamentation (8) may be attached to the purse to improve its appearance.

Near the bottom of the handbag is a horizontal opening (9) that can be securely closed by means of a zipper or other type of fastener. In this embodiment, the opening (9) is formed by a zipper sewn between the lower edge of the back panel (2) and the upper edge of the bottom panel (4). However, the opening (9) could be located in the bottom panel (4) or near or at the lower edges of the front (1) or side panels (3) as long as it is below the funnel-like partition described below. Likewise, the size of the opening (9) can be varied but should be sufficient to permit easy access by an adult hand. Furthermore, some embodiments may have two openings (e.g., one on either side) to facilitate carrying the handbag on either side of the body.

Figure 2:
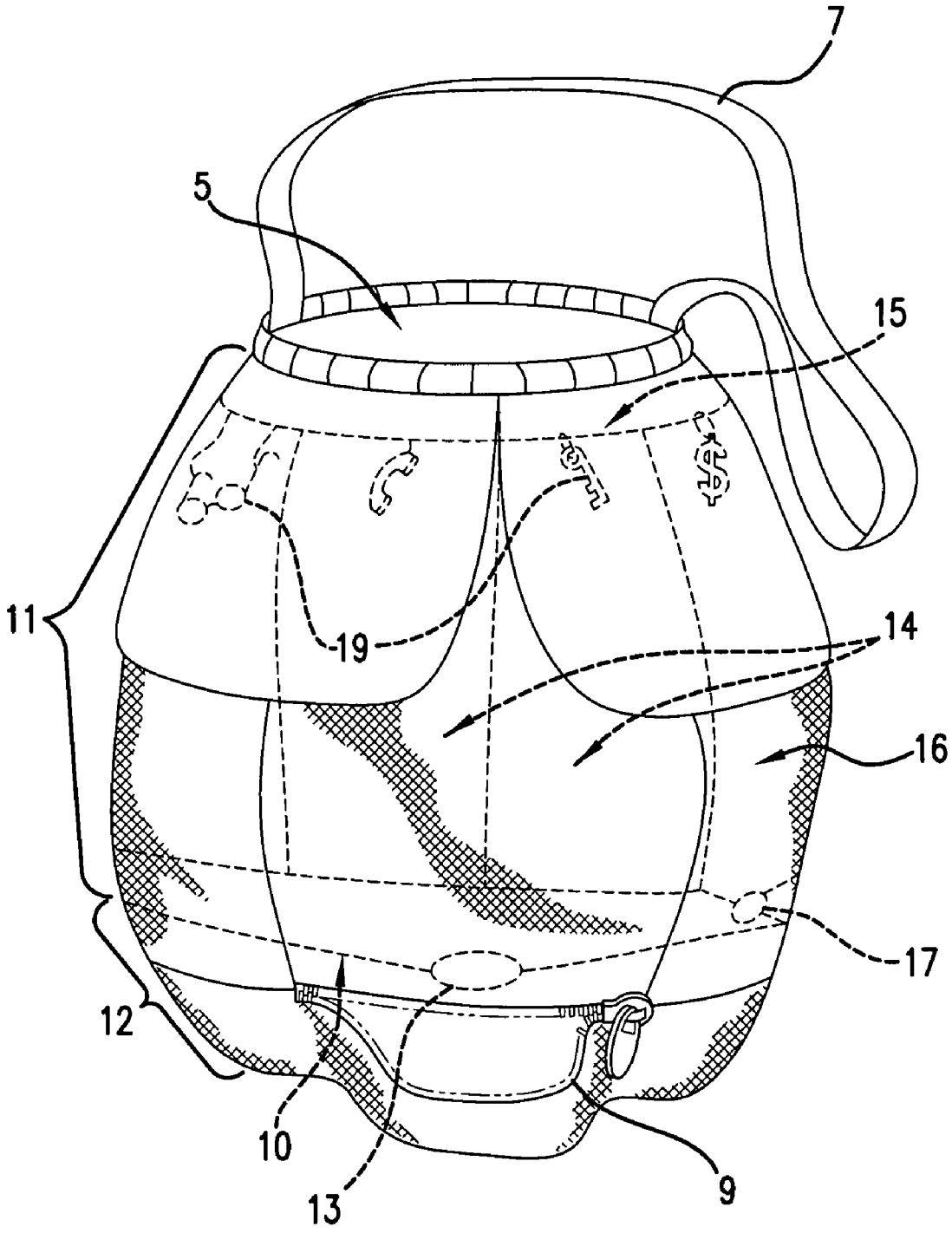
FIG. 2 shows a back hidden view of the first embodiment of the sorter handbag.

FIG. 2 shows a partition (10) that divides the bag into a more spacious upper compartment (11) and less spacious lower compartment (12). In this case the partition is located at approximately 75% of the vertical distance from the top to the bottom of the bag, although the relative sizes of the upper (11) and lower (12) compartments can be varied, and the 75% figure shown here is only an example. This partition (10) is sewn or otherwise attached to the front (1) and side panels (3) of the bag to form a "false bottom" beneath the upper compartment (11) of the handbag. The partition (10) is larger in diameter (or width and depth if the bag is rectangular rather than cylindrical) than the cross sectional diameter of the bag to provide excess material used to create a funnel shape so that the center of the partition (10) is lower than the edges of the partition (10) that are attached to the walls of the bag. A simple means of creating the funnel shape before attachment to the interior of the bag in the case of round or oval partitions (10) is to remove a wedge or triangle of material from the partition (10) such that the outer edge of the partition (10) comprises the blunt end of the wedge and the acute end of the wedge terminates at the center point of the partition. The free edges created where the wedge was removed are then joined to create the requisite funnel shape, which is deeper (lower) at the center than at the edges. The steepness of the slope described by the sides of the funnel can be varied but should be sufficient to facilitate the movement of small items towards the center of the funnel. Other means of producing a funnel shaped partition (10) and other types of funnel shaped partitions (10) will be discussed below. At the center of the partition (10) is a slot, slit or hole (13) whose size can be varied but in this case is approximately two inches long (or two inches in diameter if the hole is round) to permit the passage of small items from the upper compartment (11) to the lower compartment (12). Such passage is facilitated by jostling the purse, which will usually occur during routine activities such as walking, etc. Small items that have passed into the lower compartment (12) can be accessed by means of the previously described securable opening at the base of the back panel (2).

The upper compartment (11) of the sorter handbag shown in FIG. 2 is designed to conveniently hold larger items such as a wallet, checkbook, cellular phone, brush, etc. To achieve this purpose, it is equipped with pockets or pouches (14) made of a durable fabric or similar material that can be varied in number and size. Larger variations of the sorter handbag may naturally have more and or larger pockets (14) than smaller variations. In the example shown in FIG. 2, the pouches (14) are attached to the interior surface of the panels (1-4) that comprise the side, front, and back walls of the handbag, although other means of attaching the pockets (14) are also possible as described later. These pockets or pouches (14) can be made in a number of ways such as by sewing or otherwise attaching individual pre-formed pockets (14) to the interior of the side, front, and back panels (1-4) or by attaching a piece or pieces of fabric of a height slightly less than the height of the upper compartment (11) of the handbag to the interior of the outer wall panels to create pockets (14). In the latter case the sides of the pockets (14) are formed by vertical hems that attach the fabric to the front, back, and side panels (1-4) and the bottoms of the pockets (14) are formed by a horizontal hem that attaches the bottom of the piece of fabric to the front, back, and side panels (1-4). There are also other ways that such pockets can be formed, as would be familiar to anyone versed in the art of manufacturing clothing, handbags, and other bags for carrying personal items.

Each pocket (14) has an opening (15) at the top to facilitate access to the pockets contents. These pocket openings (15) are below the level of openings of the handbag so that the user must open the handbag and reach inside to access the pocket openings (15). However, the proximity of the pocket openings (15) to the handbag opening (5) makes the pockets (14) easily accessible to the handbag user. The pocket openings (15) may have a means of individual closure (such as a flap with a button, snap, or zipper) although this is not required. Alternatively, the pockets (14) may be provided with a band of elastic material at the top to restrain them from hanging open. The vertical height of the pockets (14) may be equal to or less than the height of the upper compartment (11) of the handbag. The width of the pockets (14) may be varied but should be sufficient to accommodate commonly carried items such as those previously described in this narrative. It is expected that not all compartments will be of the same width and height with the objective of efficiently accommodating items of various sizes. Also, some variations of the sorter handbag design may replace a pocket (14) with a fastener for holding a key chain, loop for holding a brush, or other means for securing particular items. The pockets (14) depicted in FIG. 2 represent an example of pocket (14) sizes and shapes found useful in a prototype model but other sizes and shapes are also possible.

An optional feature of the sorter handbag that can be added to the pocket (14) designated for placement of a wallet or billfold (16) is a sloping, funnel shaped bottom with a slot or hole (17) at its bottom to permit the passage of loose coinage from the pocket (16) into the upper compartment (11) of the handbag, whereby it is then free to pass through the slot (13) in the funnel-like partition (10) into the lower compartment (12) of the handbag or purse. The coinage can then be conveniently removed from the lower compartment (12) by means of the securable opening (9) near the bottom of the handbag without need to rummage in the bottom of the pocket (16).

Figure 3:
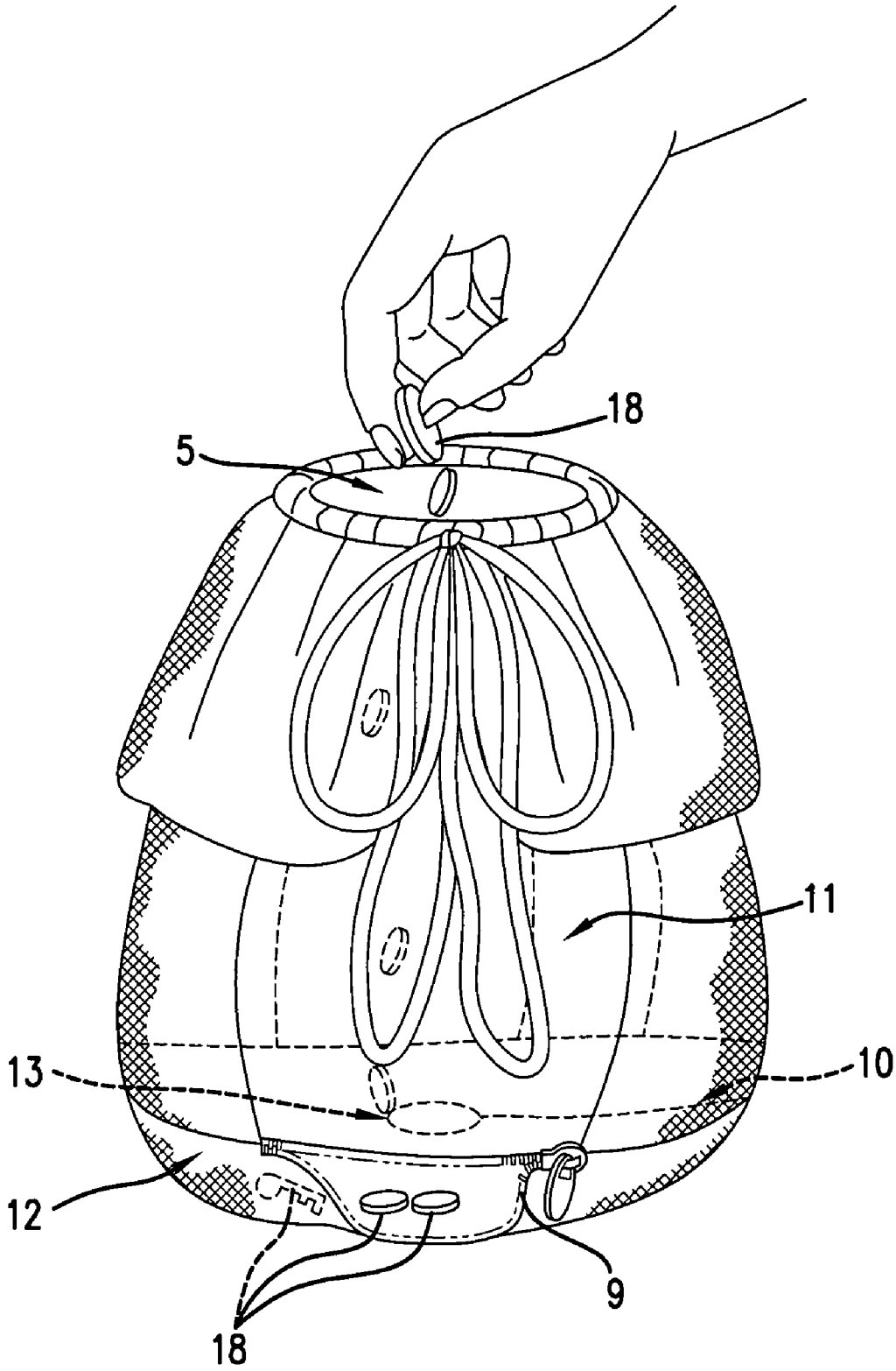
FIG. 3 shows the sorter handbag in use.

FIG. 3 depicts the sorter handbag in use. Small items (18) added through the opening (5) at the top of the handbag enter the upper compartment (11) where jostling and movement of the handbag facilitate the movement of these items (18) through the slot (13) in the funnel-like partition (10) into the lower compartment (12) of the handbag. The overall result is to produce a means for automatically (i.e., without additional or extra effort) sorting small items (18) added to the upper compartment (11) into the lower compartment (12) where they can be retrieved easily through the securable opening (9) near or at the bottom of the handbag.

Figure 4:
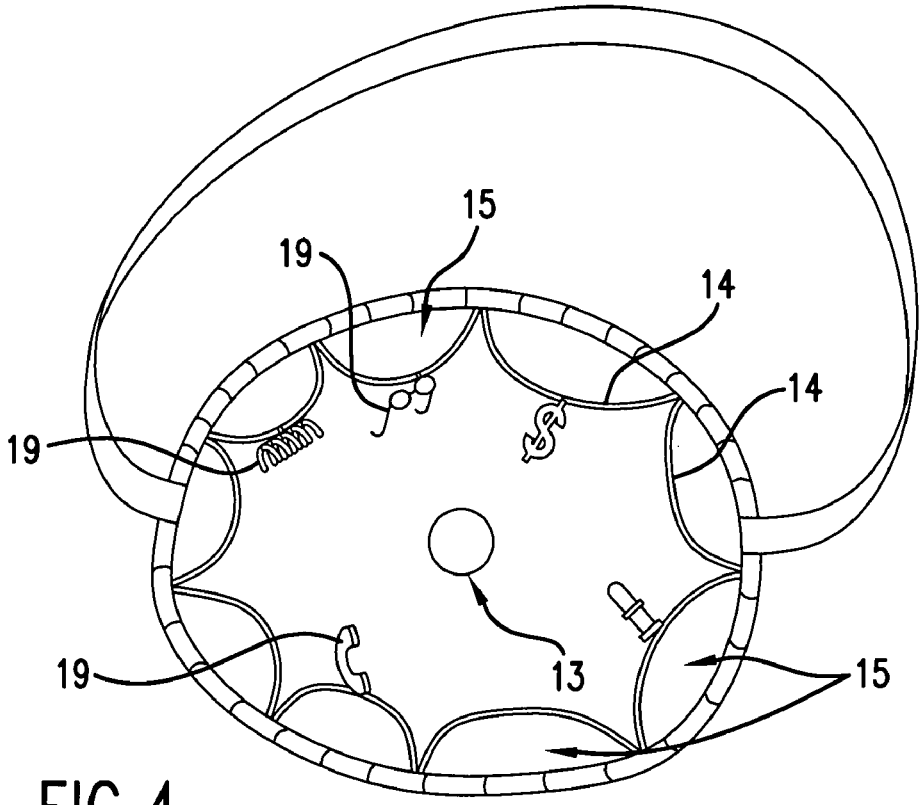
FIG. 4 shows a top view of the first embodiment of the sorter handbag in an open state.

FIG. 4 depicts a top view of the sorter handbag showing the openings (15) of the pockets (14) in the upper compartment (11) of the sorter handbag. FIG. 4 also shows another important feature of the sorter handbag, which is a means for identifying the contents of the pockets by simply looking or feeling along the upper edges of the pockets (14), thus obviating the need to gaze or reach into individual pockets (14) to determine their contents. This innovation is provided by icons (19) attached near the upper edges of the pockets (14) that are easily identifiable by vision or feel when the handbag is opened. These icons (19) can take many forms and be made of a variety of materials. They may take the form of plastic or metal charms resembling or signifying the item that is in the pocket. For example, a charm resembling a telephone receiver may be used to indicate a pocket that contains a cell phone, and a charm resembling a dollar sign may be used to indicate a pocket (14) that contains a wallet. Alternatively, the icons may take the form of small plastic or metal alphabetical characters that signify particular items. For example, the letter "C" may be used to indicate a pocket (14) that contains a checkbook, and the letter "K" may be used to indicate a pocket (14) that contains a key ring. In yet another embodiment useful for the visually impaired, the icons (19) may take the form of Braille codes for items commonly carried in a handbag. Icons (19) of any of the sort described above may be permanently attached to various pockets (14) or could be detachable such as with a pin, snap or VELCRO® so that a personalized configuration could be arranged that was most useful or appealing to the user. In the latter case, the user would be supplied with a variety of different icons that would be attached after purchase of the handbag.

Figure 5A:
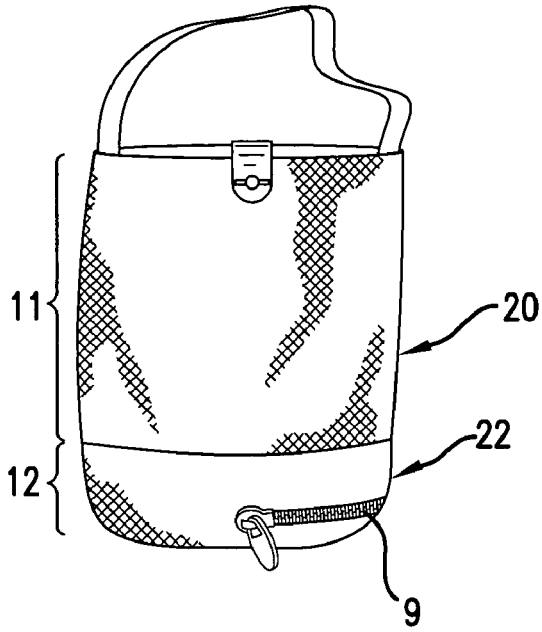
FIGS. 5A and 5B show front and right side exterior views of the second embodiment of the sorter handbag.
Figure 5B:
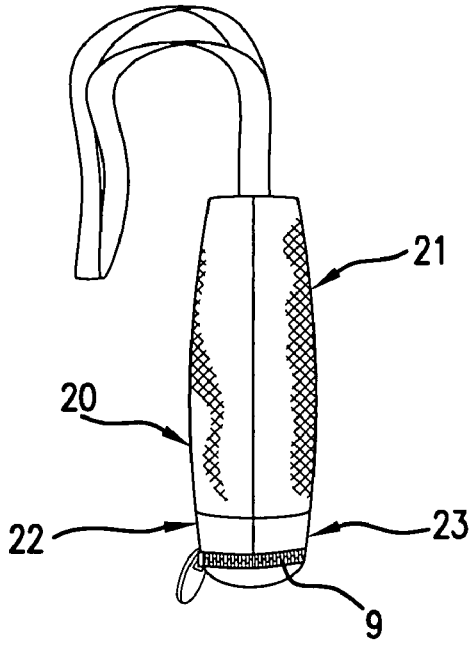
Figure 6A:
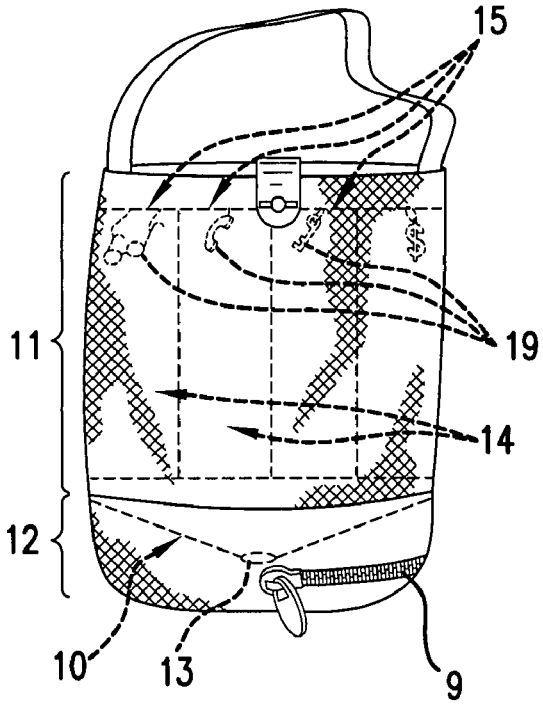
FIGS. 6A and 6B show front and right side hidden views of the second embodiment of the sorter handbag.
Figure 6B:
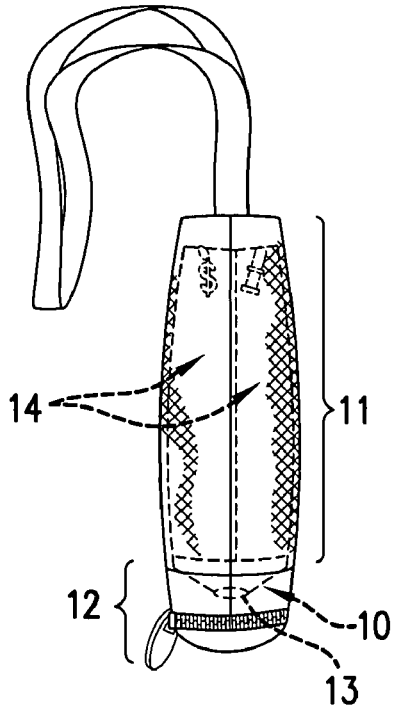

FIGS. 5A and 5B illustrate a second embodiment of the sorter handbag constructed in a different fashion than the embodiment depicted in FIGS. 1A and 1B. In this embodiment, the upper compartment (11) of the sorter handbag is composed of only a front panel (20) and back panel (21) of durable fabric attached at their vertical edges. The lower compartment (12) of this embodiment of the sorter handbag is also composed of only a front panel (22) and back panel (23), except these panels (22, 23) are only approximately 30% as high (tall) as the front (20) and back (21) panels that constitute the upper compartment (11). Referring now to FIGS. 6A and 6B, the bottom edges of the front and side panels of the upper compartment (11) are cut at angles and then attached by sewing or other appropriate methods to produce a bottom (10) for the upper compartment that forms a shallow "V"; i.e., it is deeper at the center than at the sides. The tip of the "V" is removed to create a small slot or hole (13) approximately 1.5 to 2.5 inches long (although other sizes are possible) that will permit the passage of small items. In contrast, the bottom of the lower compartment (12) is straight instead of "V" shaped like the bottom (10) of the upper compartment (11). This lower compartment (12) constitutes a shallow bag that is attached continuously along its upper edge around the entire circumference of the upper compartment (11) at a point just above where the "V" shaped bottom of the upper compartment (11) begins. A securable opening (9) or openings exist in the lower compartment (12) to provide access to small items (18) that enter the lower compartment (12) after passing through the opening (13) in the bottom of the upper compartment (11). Pockets (14) for the stowage of larger items are attached to the interior of the front and back walls of the upper compartment (11). This embodiment of the sorter handbag is constructed differently, has a different appearance, and slimmer profile than the first embodiment showing the versatility and adaptability of the sorter handbag design.

A third embodiment of the sorter handbag is described below but not illustrated in a figure. This embodiment employs a bag with outer walls made of a relatively stiff material such as leather, flexible plastic, fabric covered cardboard, etc. rather than an un-reinforced fabric. Like the previously described embodiments, this embodiment is divided into two compartments (upper and lower) by a funnel shaped partition (10) with a slot or hole for the passage of small items (18), except that, in this case, the partition (10) is composed of a relatively stiff material such as leather, flexible plastic, etc. rather than un-reinforced fabric. This embodiment also differs from the other embodiments in that the pockets (14) are attached to an inner liner rather being attached directly to the exterior walls. This liner is attached to the outer walls of the handbag near the top of the handbag and/or at various points along the sides of the handbag.

A fourth embodiment of the sorter handbag will be described next (but is not illustrated in a figure). This embodiment is similar to the third embodiment described in the previous paragraph except that the side panels and bottom of the lower compartment (12) are composed of clear plastic rather than an opaque material. This innovation permits the user to visualize the contents of the lower compartment (12).

Figure 7:
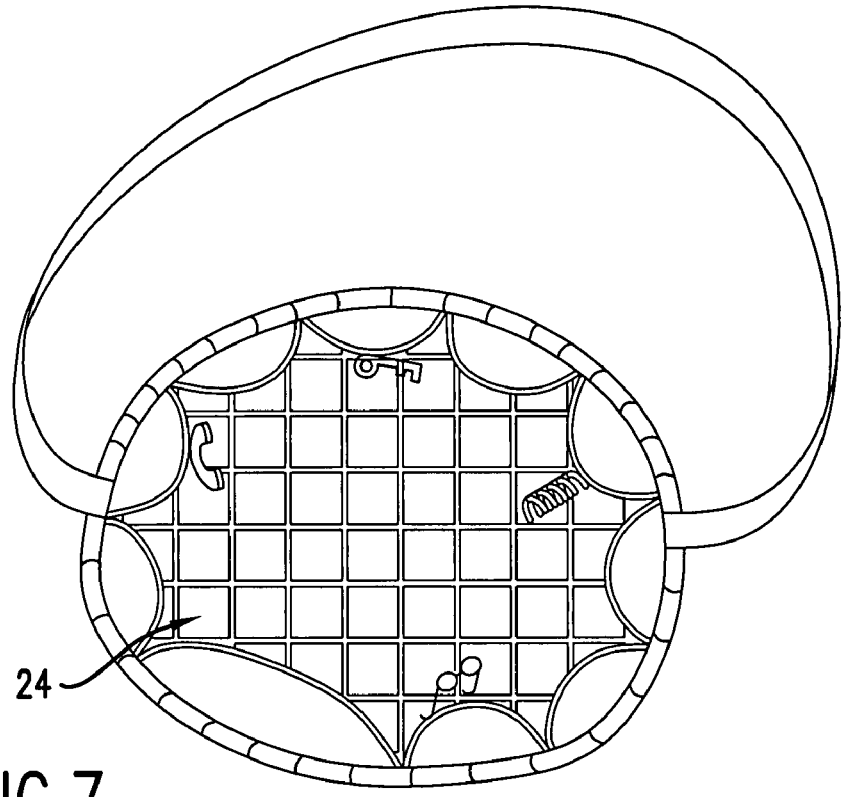
FIG. 7 shows a top view of the sixth embodiment, which incorporates a wide mesh partition.

A fifth embodiment of the sorter handbag is shown in FIG. 7. This embodiment is similar to the other embodiments in that it has a larger upper compartment (11) and smaller lower compartment (12) separated by a partition (10). However, the partition (10) that separates the compartments (11, 12) consists of a net (24) with a mesh size large enough to permit the passage of small items (18) such as coins, a key, small cosmetic items, etc. from the upper compartment (11) into the lower compartment (12). As in the other embodiments, the lower compartment (12) is provided with a securable opening (9). The net (24) can be composed of fabric, twine, plastic strips, or any other appropriate material. This embodiment can include any of the features described for the other embodiments (pockets (14), icons (19) for identifying pocket contents, etc.) and is similar to the other embodiments except that the funnel-like partition (10) is replaced by a net (24), which accomplishes the same basic function (separation of small from large items) performed by the funnel-like partition (10).

Figure 8A:
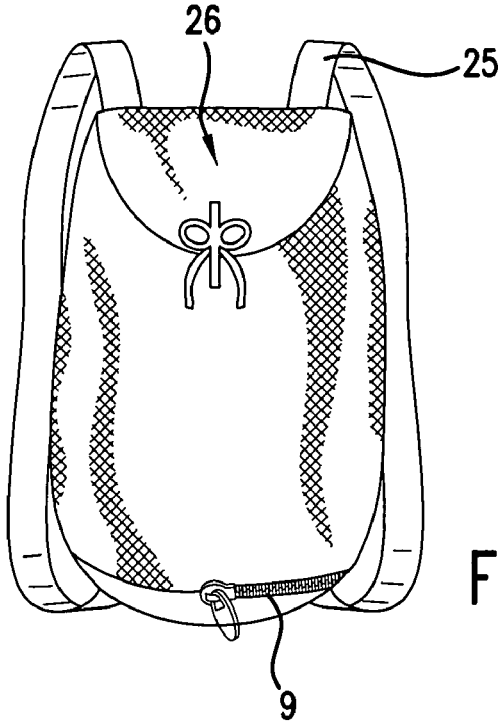
FIGS. 8A-8C show front exterior, front hidden, and right hidden views of the sorter design applied to a backpack.
Figure 8B:
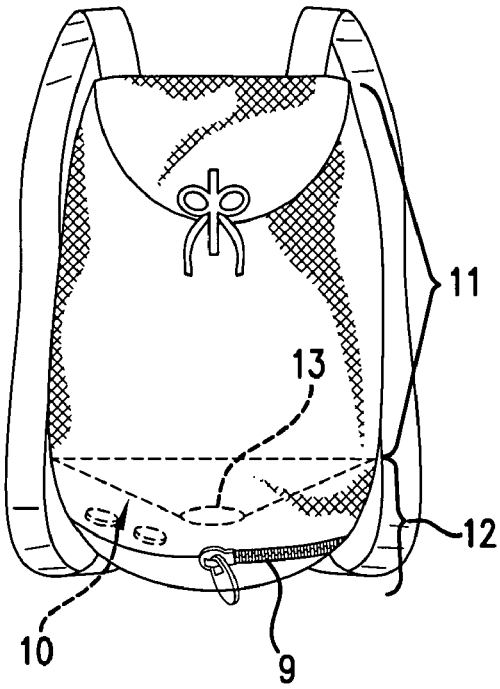
Figure 8C:
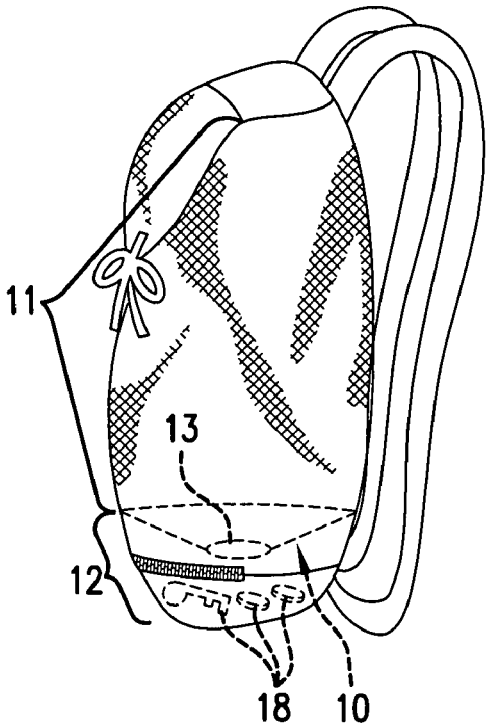

A sixth embodiment, depicted in FIGS. 8A-8C, will be described to illustrate the adaptation of the sorter design to a backpack. This embodiment is illustrative of the adaptability of the sorter design and of the ability to utilize the design (upper and lower compartment (11, 12) with funnel-like partition (10)) without pockets (14) in the upper compartment (11). This embodiment pertains to a backpack of the sort that is typically carried on a person's back by means of shoulder straps (25), that has a securable opening (26) at the top, and that is used to carry a wide variety of personal items and accessories. The use of such backpacks for the purpose of carrying books is prevalent among students, and such backpacks receive a variety of items including small items (18) such as coinage, pencils, erasers, combs, etc. These items (18) often fall to the bottom of the backpack and are difficult to retrieve without first removing the backpack contents, including heavy books, to permit a thorough search of the bottom of the backpack. As shown in FIGS. 8B and 8C, the backpack, made of a durable fabric, is divided into a relatively large upper compartment (11) and a relatively small lower compartment (12) separated by a funnel shaped partition (10), also made of a durable fabric, in one of the fashions previously described. However, the funnel-like partition in this embodiment has a larger aperture (13), approximately 5 inches in length (although other sizes are possible), than in the previous embodiments to facilitate the passage of items such as pencils, erasers, keys, coins, etc. (18) into the lower compartment (12) while retaining large items, such as books, in the upper compartment (11). Such passage is facilitated by the jostling resulting from the normal movements of the user. Small items that pass into the lower compartment (12) can be retrieved through a securable opening or openings (9) in the lower compartment (12) as previously described. This innovation saves time and reduces frustration by permitting easy access to small items (18) that are casually placed into the opening at the top of the backpack. In this embodiment, pockets in the upper compartment (11), as described in the previous embodiments, are not necessary but can be included if desired.

Obviously, it is possible to combine various aspects of the previously described embodiments of the sorter handbag. For example, an inner liner with attached pockets (14) as described for the third embodiment could easily be incorporated into the first embodiment, or the lower compartment (12) and funnel shaped partition (10) could be made of a stiff resilient material as in the third embodiment and the upper compartment (11) could be made of a flexible fabric as in the first embodiment, or the lower compartment of the third embodiment could be made of a transparent material as described for the fourth embodiment. Additionally, all of the previously described embodiments could be made in a variety of shapes as long as the basic features of the sorter handbag are retained. The most basic of these features is the presence of an upper and lower compartment (11, 12) separated by a partition (10) deigned to facilitate the passage of small items (18) from the upper to the lower compartment (11, 12) combined with a securable opening in the lower compartment (12) to facilitate retrieval of these items. Another feature desirable in most (but not necessarily all) embodiments is the presence of pockets (14) in the upper compartment (11) to retain larger items. Icons (19) for identification of pocket contents, as described for the first embodiment, are a desirable but not essential feature of all embodiments of the sorter handbag design. It is also obvious that the sorter handbag could be produced in a variety of colors, materials, and ornamental designs, and that minor features such as external decorations, type and position of handles, carrying straps, and fasteners could be varied in many ways without compromising the basic features of the sorter handbag design.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

That which is claimed:

1. A bag, comprising:

a body;

an upper compartment at least partially defined by said body and configured for holding items therein, wherein said body defines a top opening to allow access to said upper compartment;

a lower compartment at least partially defined by said body and configured for holding items therein, wherein said body defines a selectively closable lower compartment opening to allow access to said lower compartment when opened; and a partition defining a flexible fabric disposed between said upper compartment and said lower compartment, said partition defining an arcuate opening having an upper edge in communication with said upper compartment and a lower edge in communication with said lower compartment, said partition further defining a sloping wall in communication with said arcuate opening to allow transfer of coins and irregularly shaped objects from said upper compartment to said lower compartment based on the size and shape of the items so as to sort the items between said upper and lower compartments.

2. The bag as set forth in claim 1, wherein said partition is V-shaped.

3. The bag as set forth in claim 1, wherein said body defines a plurality of pockets in said upper compartment configured for receiving items therein.

4. The bag as set forth in claim 3, further comprising indicia configured for identifying different said pockets through tactile sensation.

5. The bag as set forth in claim 4, wherein said indicia are located at the top of said pockets.

6. The bag as set forth in claim 3, wherein at least one of said pockets has a bottom in the shape of a funnel that defines a pocket aperture to allow transfer of items from said pocket to said upper compartment based on the size and shape of the items so as to sort the items between said pocket and said upper compartment.

7. The bag as set forth in claim 1, wherein said bag is selected from the group consisting of a handbag, a purse, a tote bag, and a knapsack.

8. The bag as set forth in claim 1, wherein said selectively closable lower compartment opening includes a horizontal zipper to allow selective access to said lower compartment.

9. A bag, comprising:

a body;

an upper compartment defined by said body and configured for holding items therein, wherein said body defines a selectively closable upper compartment opening to allow access to said upper compartment, wherein said body defines at least one pocket configured for receiving items therein;

a lower compartment defined by said body, said lower compartment configured for holding items therein, wherein said body defines a selectively closable lower compartment opening to allow access to said lower compartment, wherein said lower compartment has a smaller volume than said upper compartment; and a flexible fabric partition disposed between said upper compartment and said lower compartment, said partition defining an arcuate opening of between about 1.5" to 2.5" in communication with said upper compartment and with said lower compartment to allow transfer of coins and irregularly shaped objects from said upper compartment to said lower compartment based on the size and shape of the items so as to sort the items between said upper and lower compartments.

10. The bag as set forth in claim 9, wherein said partition is made of a flexible material with an unattached cross-section larger than the cross-section of said body so as to be formed in the shape of a funnel having said arcuate opening located below the connection of said body and said funnel shaped partition.

11. The bag as set forth in claim 9, wherein said body has a front panel, a back panel, a pair of side panels disposed between said front and back panels, and a bottom panel contiguous with said front panel, said back panel, and said side panels.

12. The bag as set forth in claim 9, further comprising a shoulder strap attached to said body.

13. The bag as set forth in claim 9, further comprising a plurality of pockets defined in said upper compartment and configured for receiving items therein further including indicia configured for identifying said pockets through tactile sensation.

14. The bag as set forth in claim 13, wherein said indicia are located at the top of said pockets.

15. The bag as set forth in claim 14, wherein at least one of said pockets has a bottom that defines a pocket opening, said pocket opening in communication with sloping wall portions of said pocket bottom to allow transfer of items from said pocket to said upper compartment based on the size and shape of the items so as to sort the items between said pocket and said upper compartment.

16. The bag as set forth in claim 9, wherein said bag is selected from the group consisting of a handbag, a purse, a tote bag, a backpack, and a knapsack.

17. The bag as set forth in claim 9, wherein said selectively closable lower compartment opening is selectively closable by a zipper.

18. A bag, comprising:

a body;

an upper compartment defined by said body and a partition, said upper compartment configured for holding items therein, wherein said body defines a selectively closable upper compartment opening to allow access to said upper compartment; wherein said body defines a plurality of pockets configured for receiving items therein;

detachable icons located at the top of said pockets and configured for identifying said pockets by way of tactile sensation;

a lower compartment defined by said body and said partition, said lower compartment configured for holding items therein, wherein said body defines a selectively closable lower compartment opening to allow access to said lower compartment, wherein said lower compartment has a smaller volume than said upper compartment; and said partition disposed between said upper compartment and said lower compartment, said partition being a flexible fabric defining a arcuate opening of about 1.5" to about 2.5" having an upper portion in communication with sloping walls defined by said upper compartment and lower portion in communication with said lower compartment to allow transfer of coins and irregularly shaped items from said upper compartment to said lower compartment based on the size and shape of the items so as to sort the items between said upper and lower compartments;

wherein at least one of said pockets has a bottom defining an arcuate pocket opening in communication with a sloping wall defined by a portion of said bottom of at least one of said pockets to allow transfer of items from said pocket to said upper compartment based on the size and shape of the items so as to sort the items between said pocket and said upper compartment.

* * * * *